US008448619B2

(12) United States Patent
Gresley et al.

(10) Patent No.: US 8,448,619 B2
(45) Date of Patent: May 28, 2013

(54) OFFSET ROCKER ARM ASSEMBLY FOR THRUST LOAD APPLICATIONS

(75) Inventors: Ross Gresley, Fort Mill, SC (US); Richard Baker, Sterling Heights, MI (US); Marion Ince, Mount Holly, NC (US); Mike Turner, Fort Mill, SC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 551 days.

(21) Appl. No.: 12/580,522

(22) Filed: Oct. 16, 2009

(65) Prior Publication Data

US 2010/0170462 A1 Jul. 8, 2010

Related U.S. Application Data

(60) Provisional application No. 61/106,224, filed on Oct. 17, 2008.

(51) Int. Cl.
*F01L 1/18* (2006.01)

(52) U.S. Cl.
USPC ..... 123/90.41; 123/90.39

(58) Field of Classification Search
USPC ..... 123/90.39–90.47
See application file for complete search history.

(56) References Cited

U.S. PATENT DOCUMENTS

| | | | | | |
|---|---|---|---|---|---|
| 4,476,824 | A * | 10/1984 | Reinke et al. | 123/90.39 |
| 5,123,384 | A * | 6/1992 | Abbas | 123/90.39 |
| 5,329,891 | A * | 7/1994 | Murphy et al. | 123/90.39 |
| 5,437,209 | A * | 8/1995 | Santoro | 74/559 |
| 6,694,936 | B2 * | 2/2004 | Stallmann | 123/90.41 |
| 2004/0126045 | A1 * | 7/2004 | Falone et al. | 384/492 |
| 2006/0126985 | A1 * | 6/2006 | Ochi et al. | 384/625 |
| 2008/0271692 | A1 * | 11/2008 | Weaver | 123/90.39 |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

The bearing for a rocker arm assembly has rolling elements positioned between an outer sleeve and an inner sleeve for supporting the radial load between the support pin and the rocker arm and an inner and outer bearing wall that abut one another and supports the axial load in the assembly.

13 Claims, 5 Drawing Sheets

OFFSET ROCKER ARM ASSEMBLY FOR THRUST LOAD APPLICATIONS

CROSS REFERENCE TO RELATED APPLICATION

This application claims the priority under 35 USC 119 of U.S. Provisional Application No. 61/106,224 filed Oct. 17, 2008, and incorporates the same by reference herein.

FIELD OF THE INVENTION

This Invention relates to rocker arm assemblies for a valve train of an internal combustion engine and, more particularly, to a bearing arrangement used in a pedestal mounted rocker arm assembly used in a push rod style engine where the rocker arm is offset and/or the pushrod imparts a thrust load on the bearing of the rocker arm.

BACKGROUND OF THE INVENTION

Pedestal mounted rocker arm assemblies have a rocker arm rotatably mounted on a support pin and the support pin is fixed to the cylinder head through the pedestal. The support pin is also known as a trunnion. Conventionally, the support pin rests on a pedestal, also known as a support block which positions the overall rocker arm assembly away from the cylinder head. One end of the rocker arm is in contact with the push rod while the other end of the rocker arm is in contact with a valve shaft.

Roller bodies, also referred to as radial bearings are conventionally used between the support pin and the rocker arm to facilitate rotational movement of the rocker arm on the support pin and to handle radial loads.

Rocker arm assemblies can also be subject to axial forces or thrust forces. These axial forces occur when certain parts are out of alignment, for example, when the rocker arm pallet and the socket, the lower end of the push rod and the socket, or the valve shaft and the rocker arm pallet are out of alignment. Such rocker arm assemblies are often referred to as "offset rocker arm assemblies".

Solutions for handling thrust forces in rocker arm assemblies are taught in U.S. Pat. No. 6,694,936 and U.S. Patent Publication No. 2008/0098971.

OBJECT OF THE INVENTION

It is the object of the present Invention to provide a rocker arm assembly that can handle coupled moments, in other words, both radial and thrust (axial) loads. It is also the object of the present Invention to provide a rocker arm assembly which is smaller and more cost effective than previous designs.

These and other objects of the present Invention will be more readily understood by reference to the following description of the Invention.

SUMMARY OF THE INVENTION

The objects of the present Invention are obtained by employing a bearing having rolling elements between an inner sleeve and an outer sleeve for supporting radial forces; and the outer sleeve has an outer bearing wall extending radially inward from the outer sleeve and covering the axial end of the support pin. Either the inner sleeve has an inner bearing wall that extends radially inward to cover the axial end wall of the support pin such that the outer bearing wall and the inner bearing wall interact to support axial loads; or the outer surface of the axial end wall of the support pin is conditioned to support axial loads with the outer bearing wall.

Broadly, the present Invention can be defined as follows:

A rocker arm assembly for use in an internal combustion engine where the assembly is pedistally mounted on a cylinder head in a push rod style engine, comprising:

a rocker arm having a transverse through hole;

a support pin positioned in the through hole and about which the rocker arm rocks; and a bearing positioned at each end of the support pin in the through hole between the support pin and the rocker arm;

wherein the bearing comprises an outer sleeve abutting an inner circumferential wall of the through hole, and having an outer bearing wall that extends radially inward and covers the through hole;

an inner sleeve abutting an outer circumferential wall of the support pin, and optionally having an inner bearing wall that extends radially inward and covers the axial end wall of the support pin;

the outer bearing wall abutting an axial end wall of the support pin or the inner bearing wall to accommodate axial loads; and rolling elements positioned between and in contact with the inner and outer sleeve to accommodate radial loads.

When the inner sleeve has an inner bearing wall, the outer bearing wall abuts the inner bearing wall to support axial loads. When the axial end wall of the support pin acts as the inner bearing wall, the outer bearing wall abuts the axial end wall of the support pin to accommodate axial loads and the inner sleeve does not have the inner bearing wall. In both of these embodiments, the outer bearing wall abuts and is in contact with either the inner bearing wall or the axial end wall of the support pin to support axial loads. In either case, no thrust washer or rolling elements are employed to support the axial/thrust loads imparted by the remainder of the valve train.

Where an inner bearing wall is employed, it is preferred that a hole is located in the inner bearing wall.

The rolling elements are suitably cylindrical rollers or needle rollers.

It is preferred that the outer bearing wall has an outer retention shoulder for the rolling elements and the inner sleeve has an inner retention flange for the rolling elements. Alternatively, the outer bearing wall has an outer retention shoulder for the rolling elements and the outer bearing sleeve has an inner retention flange for the rolling elements. Alternatively, the inner bearing sleeve has an inner retention flange and an outer retention flange for the rolling elements.

It is also preferred that the outer bearing wall has a hole in it.

A coating, such as Teflon®, a diamond-like coating, or other low frictional coatings or friction modifying coatings can be employed on either the inner bearing surface of the outer bearing wall, the outer bearing surface of the inner bearing wall or the outer bearing surface of the axial end wall of the support pin when it acts as the outer bearing surface. Either one or both of these surfaces can be coated.

Alternatively, a textured oil retaining surface could be configured on either the inner bearing surface of the outer bearing wall, the outer bearing surface of the inner bearing wall, or the outer bearing surface of the axial end wall of the support pin when it acts as the outer bearing surface. Either one of these surfaces is textured or both of the opposing surfaces are textured to retain oil. Such texturing of surface can be conventional and can be made in a conventional manner.

Additionally, it is preferred that when the axial end wall of the pin acts as an outer bearing surface, that this outer bearing surface be hardened in a conventional manner.

BRIEF DESCRIPTION OF THE DRAWINGS

These and other aspects of the present Invention may be more readily understood by reference to one or more of the following drawings which are presented for purposes of illustration only.

DETAILED DESCRIPTION OF THE DRAWINGS

Figure 1:
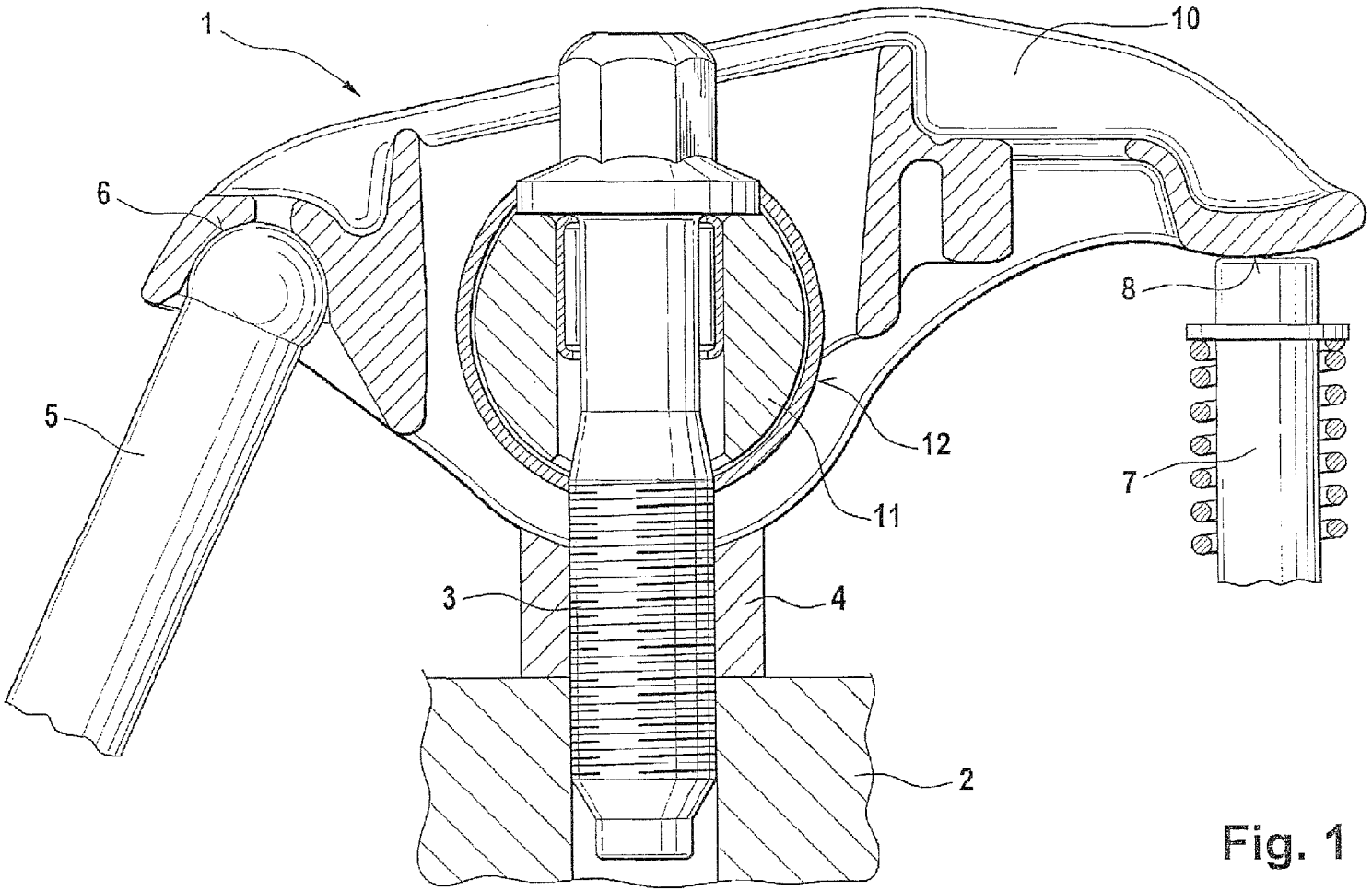
FIG. 1 illustrates a longitudinal sectional view of rocker arm assembly.

FIG. 1 illustrates rocker arm assembly 1 affixed to cylinder head 2 by fastening bolt 3. Support block 4, pedestal, is positioned between assembly 1 and cylinder head 2. Push rod 5 contacts push rod ball socket 6 while valve shaft 7 contacts valve shaft end 8 of rocker arm assembly 1.

Rocker arm assembly 1 has rocker arm 10 which rotates about support pin 11. Support pin 11 is held stationary by fastening bolt 3. Support pin 11 passes through a transverse through hole 12.

Figure 2:
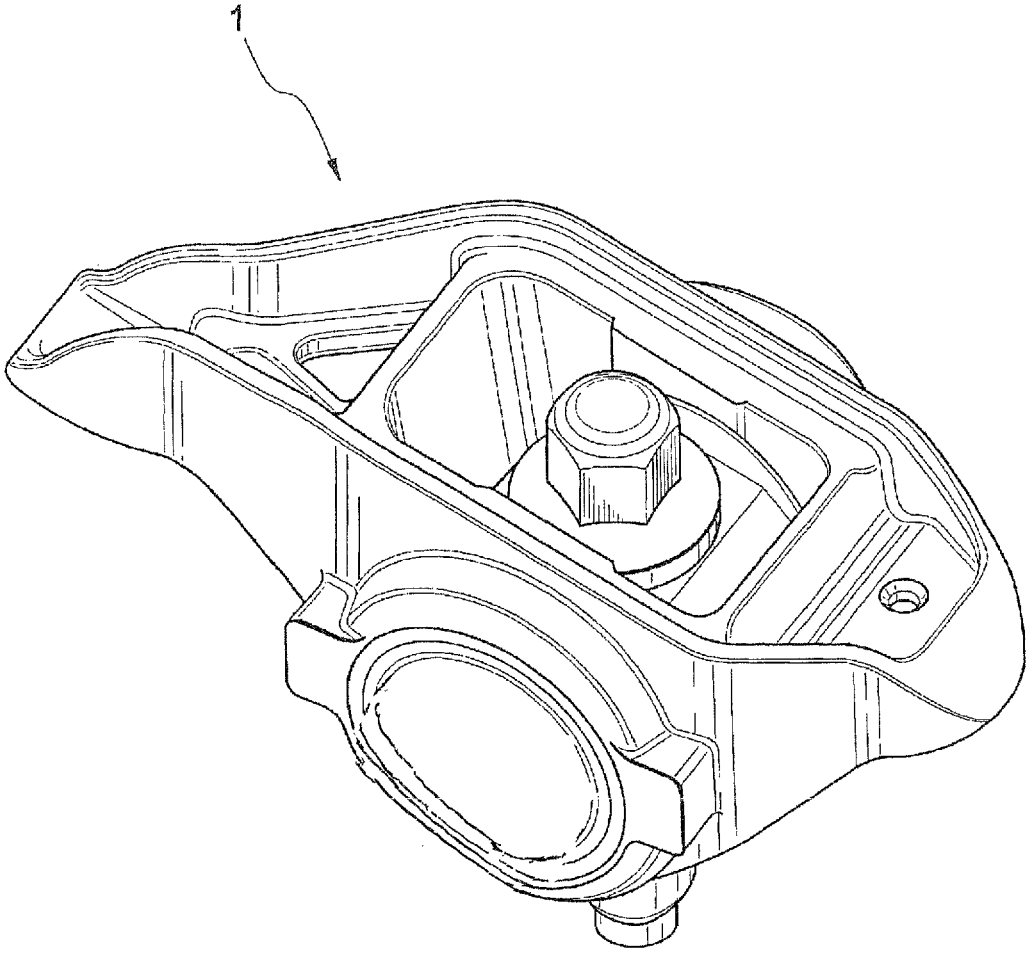
FIG. 2 illustrates the offset design of the rocker arm assemblies.

As shown in FIG. 2, rocker arm assembly 1 is offset. As can be seen, the push rod, the ball socket and the rocker arm pallet do not lie on the same longitudinal plane. Such a rocker arm assembly is often chosen to accommodate large exhaust and intake port geometries which are needed to meet engine power requirements while meeting packaging constraints. It should be understood that the bearing assembly of the present Invention can also be used in conventional straight line rocker arm assemblies with and without thrust loads imparted by the pushrod.

Figure 3:
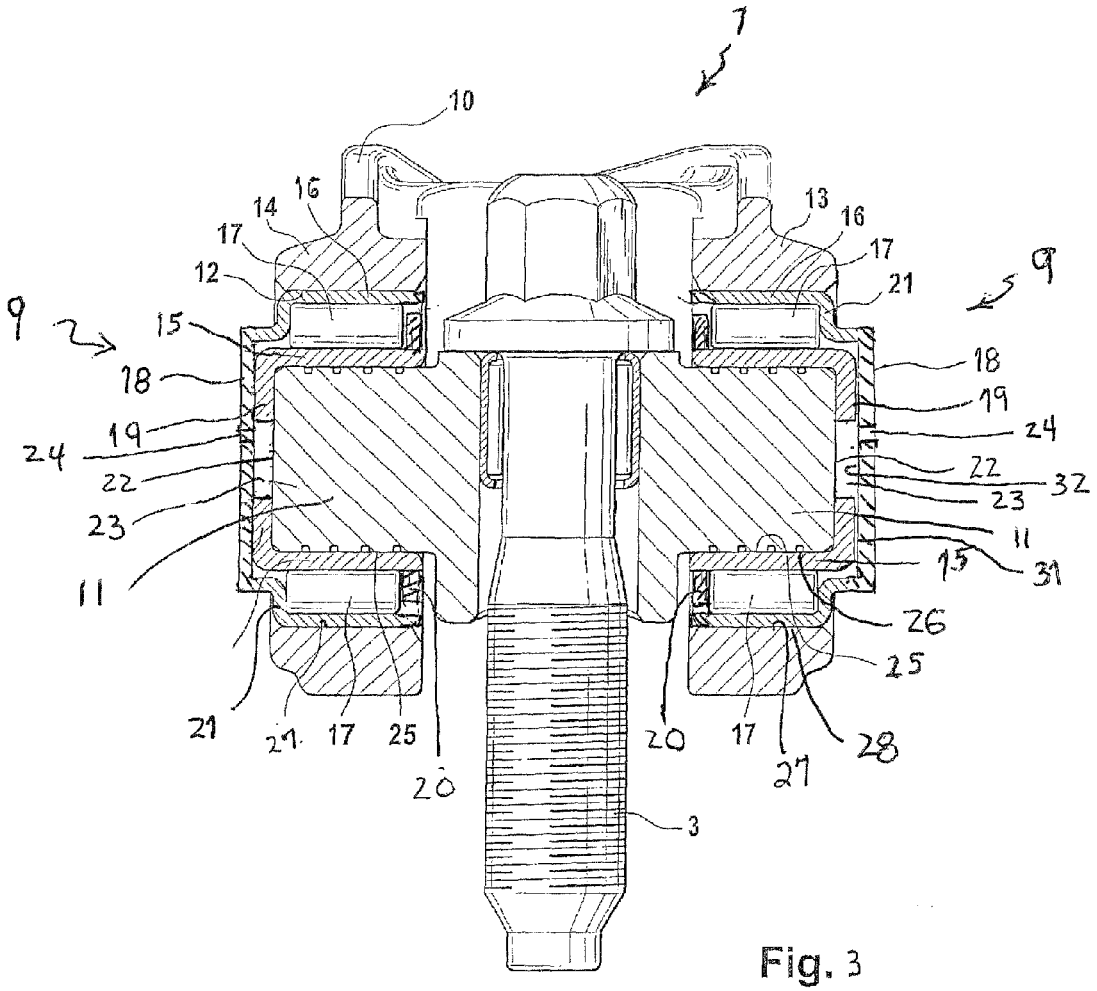
FIG. 3 illustrates the transverse cross sectional view of the rocker arm assembly having both inner and outer bearing walls and an inner retention flange on the inner sleeve and an outer retention shoulder on the outer bearing wall.

As shown in FIG. 3, through hole 12 passes through rocker arm wall 13 and rocker arm wall 14 thereby making a through hole in rocker arm 10. Support pin 11 is positioned in through hole 12 and allows rocker arm 10 to rotate about pin 11.

Bearing 9 is positioned at each axial end of support pin 11. Each bearing 9 has inner sleeve 15, outer sleeve 16 and rolling elements 17 positioned between inner sleeve 15 and outer sleeve 16. This arrangement handles radial forces in the rocker arm assembly.

Outer sleeve 16 has outer bearing wall 18 and inner sleeve 15 has inner bearing wall 19. Outer bearing wall 18 abuts inner bearing wall 19 to support axial forces in the rocker arm assembly.

In order to retain rolling elements 17, inner retention flange 20 on inner sleeve 15 is employed in conjunction with outer retention shoulder 21 on outer bearing wall 18.

Support pin 11 has two axial end walls 22. Inner bearing wall 19 abuts axial end wall 22. Hole 23 is located in inner bearing wall 19. Hole 23 is incorporated into inner bearing wall 19 to prevent air from being trapped during the assembly of sleeve 15 onto support pin 11. Hole 23 also provides an oil reservoir for the thrust surfaces. The thrust surfaces, the surfaces handling the axial load, is outer bearing surface 31 and inner bearing surface 32.

Circumferential outer wall 25 of support pin 11 abuts and is in tight contact with circumferential inner wall 26 of inner sleeve 15. Circumferential inner wall 27 of through hole 12 abuts and is in tight contact with circumferential outer wall 28 of outer sleeve 16. The press fit between circumferential outer wall 25 and circumferential inner wall 26 as well as circumferential outer wall 28 and circumferential inner wall 27 holds bearing 9 into rocker arm assembly 1.

Figure 4:
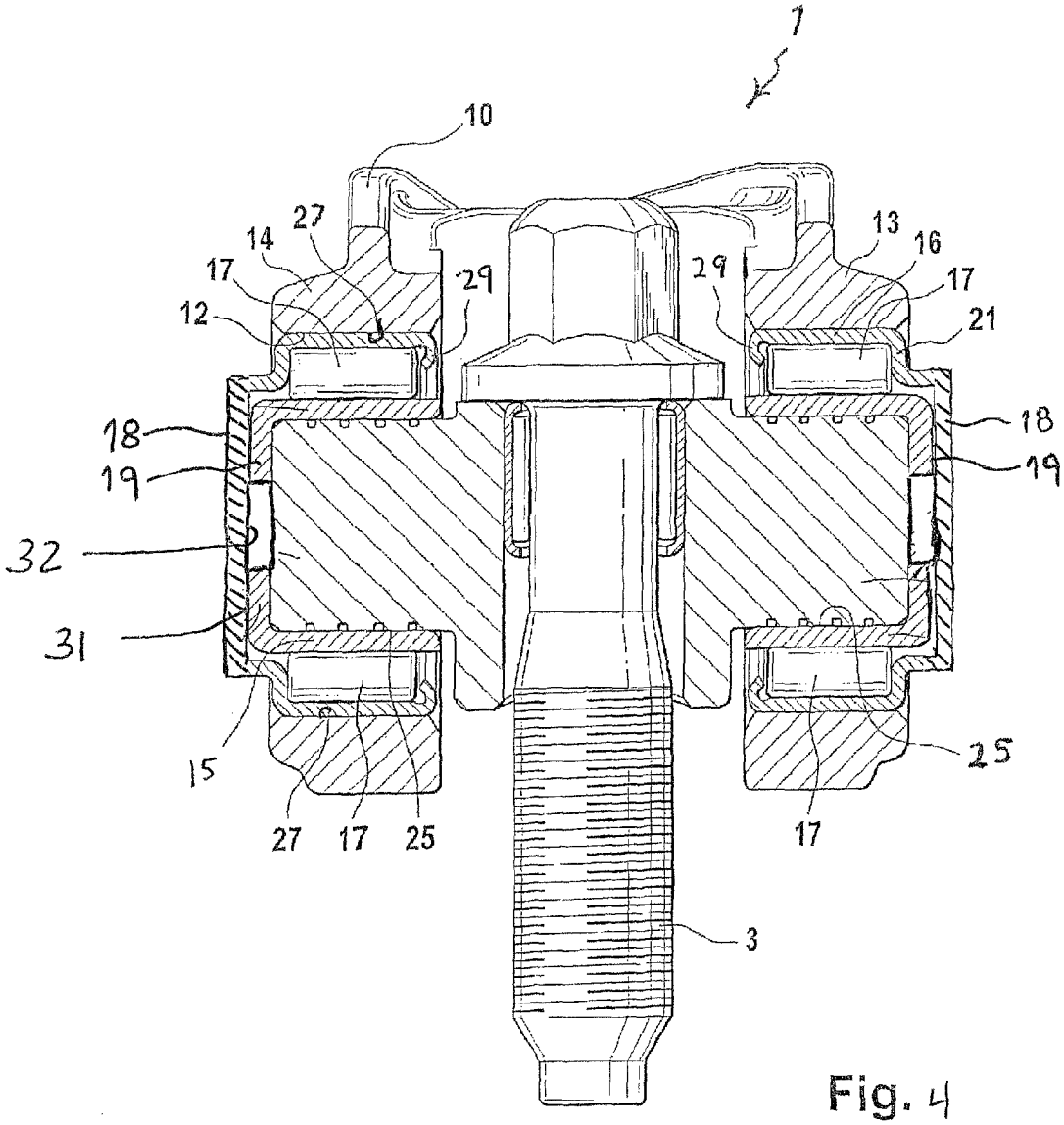
FIG. 4 illustrates a transverse cross sectional view of the rocker arm assembly with an outer and inner bearing wall and inner retention flange on the outer sleeve and outer retention shoulder on the outer bearing wall.

FIG. 4 illustrates rocker arm assembly 1 wherein bearing 9 has outer sleeve 16 with inner retention flange 29. In this embodiment, outer sleeve 16 provides both outer retention shoulder 21 and inner retention flange 29 for retaining rolling elements 17 in the bearing.

Figure 5:
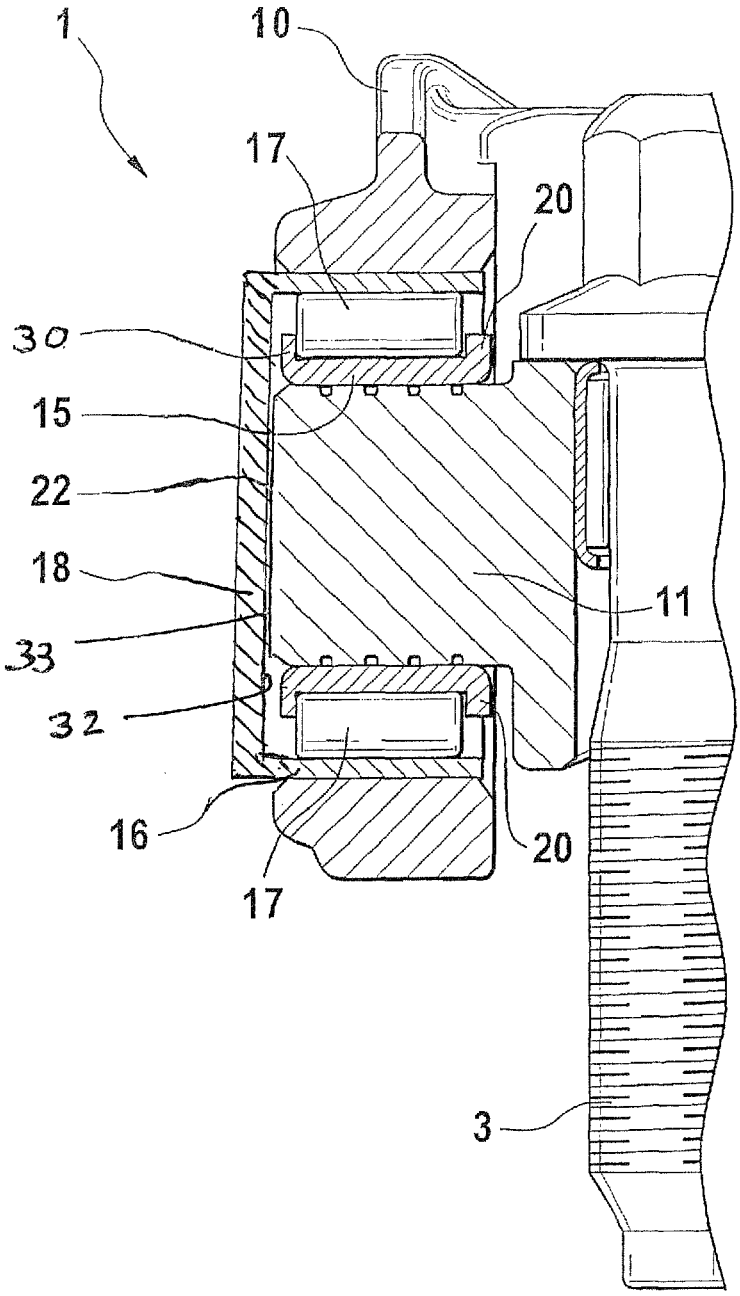
FIG. 5 illustrates a transverse cross sectional view of the rocker arm assembly having an outer bearing wall and an inner bearing surface on the axial end wall of the support pin, inner and outer retention flanges are illustrated on the inner sleeve.

As shown in FIG. 5, inner sleeve 15 has both inner retention flange 20 and outer retention flange 30. Inner retention flange 20 and outer retention flange 30 retains rolling elements 17 in the bearing.

Also, as shown in FIG. 5, outer sleeve 16 has outer bearing wall 18 with inner bearing surface 32 in close contact with outer bearing surface 33 of axial end wall 22 of pin 11. In this embodiment, axial end wall 22 acts as the outer bearing surface 33 for interacting with inner bearing surface 32 for supporting axial loads on rocker arm assembly 1.

When employing flange 20 on inner sleeve 15, it reduces race taper induced by the press fit of inner sleeve 15 on support pin 11 and improves the life of bearing 9. Additionally, in board flange 20 on inner sleeve 15 permits an in board open end on outer sleeve 16 to promote oil flow through the bearing to prevent coke or varnish formation and allows debris particles to be flushed out of the bearing and to pass through the bearing without potentially damaging the bearing. Hole 24 in outer bearing wall 18 also allows for the outward passage of debris particle from bearing 9.

Oil retaining surface textures can be employed in the outer bearing surface 31, 33 and the inner bearing surface 32.

Outer bearing surface 31 and 33 and inner bearing surface 32 can employ flat, domed/crowned or incorporate other geometric features that promote oiling and reduce and/or eliminate edge loading.

When axial end wall 22 of pin 11 is employed as outer bearing surface 33, surface 33 can be hardened in a conventional manner.

Coatings can be employed on surfaces 31, 32 and 33 in order to modify or reduce the friction and improve durability. Conventional coatings, such as, Teflon®, diamond-like coatings as well as other conventional coatings may be employed on one or both surfaces.

The rolling elements 17 are illustrated as generally cylindrical, however, needle rollers or spherical rollers can be employed.

REFERENCE CHARACTERS

1. Rocker arm assembly
2. cylinder head
3. fastening bolt
4. support block (pedestal)
5. push rod
6. push rod ball socket
7. Valve stem
8. end of valve stem

9. bearing
10. rocker arm
11. support pin
12. transverse through hole
13. rocker arm side wall
14. rocker arm side wall
15. inner sleeve
16. outer sleeve
17. rolling elements
18. outer bearing wall
19. inner bearing wall
20. inner retention flange on inner sleeve
21. outer retention shoulder on outer bearing wall
22. axial end wall of pin
23. hole in inner bearing wall
24. hole in outer bearing wall
25. circumferential outer wall of pin
26. circumferential inner wall of inner sleeve
27. circumferential inner wall of through hole
28. circumferential outer wall of outer sleeve
29. inner retention flange on outer sleeve
30. outer retention flange on inner sleeve
31. outer bearing surface of inner bearing wall
32. inner bearing surface of outer bearing wall
33. outer bearing surface of axial end wall of pin

What we claim is:

1. A rocker arm assembly for use in an internal combustion engine where the assembly is pedistally mounted on a cylinder head in a push rod style engine, comprising:

a rocker arm having a transverse through hole;

a support pin having an axis of rotation and positioned in the through hole such that the rocker arm is rockable about the axis of rotation; and a bearing positioned at each end of the support pin in the through hole between the support pin and the rocker arm;

wherein the bearing comprises:

an outer sleeve abutting an inner circumferential wall of the through hole, and having an outer bearing wall that extends radially inward and covers the through hole, the outer bearing wall having an outer retention shoulder for the rolling elements and the outer bearing sleeve having an inner retention flange for the rolling elements;

an inner sleeve abutting an outer circumferential wall of the support pin, and having an inner bearing wall that extends radially inward toward the axis of rotation of the support pin so as to cover an axial end wall of the support pin, and the inner bearing wall having a hole located at the axis of rotation of the support pin, the inner sleeve having an axially inner open end;

the outer bearing wall abutting the inner bearing wall to accommodate axial loads; and rolling elements positioned between and in contact with the inner and outer sleeve to accommodate radial loads.

2. The assembly of claim 1, wherein the outer bearing wall has a hole.

3. The assembly of claim 1, wherein the inner bearing wall has an outer bearing surface with a coating.

4. The assembly of claim 3, wherein the coating is Teflon®, a diamond-like coating, or other friction modifying coatings.

5. The assembly of claim 1, wherein the outer bearing wall has an inner bearing surface with a coating.

6. The assembly of claim 1, wherein the inner bearing will has an outer bearing surface with a textured oil retentive surface.

7. The assembly of claim 6, wherein the textured surface is such as to modify friction.

8. The assembly of claim 1, wherein the outer bearing wall has an inner bearing surface with a textured oil retentive surface.

9. A rocker arm assembly for use in an internal combustion engine where the assembly is pedistally mounted on a cylinder head in a push rod style engine, comprising:

a rocker arm having a transverse through hole;

a support pin positioned in the through hole and about which the rocker arm rocks; and a bearing position at each end of the support pin in the through hole between the support pin and the rocker arm;

wherein the bearing comprises:

an outer sleeve abutting an inner circumferential wall of the through hole, and having an outer bearing wall that extends radially inward and covers the through hole;

an inner sleeve abutting an outer circumferential wall of the support pin, the inner bearing sleeve having an inner retention flange and an outer retention flange that extend parallel to each other to retain the rolling elements, the outer sleeve having an axially inner open end configured to promote oil flow through the bearing;

the outer bearing wall abutting an axial end wall of the support pin to accommodate axial loads; and rolling elements positioned between and in contact with the inner and outer sleeve to accommodate radial loads.

10. The assembly of claim 9, wherein the axial end wall of the support pin is subject to a hardening process prior to assembly.

11. The assembly of claim 9, wherein the axial end wall of the support pin has a coating.

12. The assembly of claim 9, wherein the outer bearing wall has an inner bearing surface with a coating.

13. The assembly of claim 9, wherein the outer bearing surface and inner bearing surface have flat, domed/crowned or other geometric features to promote oiling and reduce and/or eliminate edge loading.

* * * * *